US005643162A

United States Patent [19]

Landers et al.

[11] Patent Number: 5,643,162

[45] Date of Patent: Jul. 1, 1997

[54] EXERCISE APPARATUS

[75] Inventors: Jeffrey A. Landers, 29-23 212 St., Bayside, N.Y. 11360; Milton Phillip Chernack, New York, N.Y.

[73] Assignee: Jeffrey A. Landers, New York, N.Y.

[21] Appl. No.: 355,480

[22] Filed: Dec. 14, 1994

[51] Int. Cl.[6] ..... A63B 21/00

[52] U.S. Cl. ..... 482/131; 482/9; 482/907

[58] Field of Search ..... 482/141, 142, 482/91, 137, 907, 130, 123, 126, 120, 129, 135

[56] References Cited

U.S. PATENT DOCUMENTS

| | | | |
|---|---|---|---|
| 1,536,048 | 9/1925 | Alastalo . | |
| 1,630,467 | 9/1927 | Bradstreet . | |
| 1,982,843 | 6/1934 | Traver . | |
| 1,997,139 | 4/1935 | Gardener et al. | 482/132 |
| 2,114,790 | 5/1938 | Venables . | |
| 2,821,394 | 12/1954 | Barbeau . | |
| 3,134,590 | 5/1964 | Young . | |
| 3,403,906 | 10/1968 | Burzenski . | |
| 3,797,824 | 3/1974 | Osbourne | 482/137 |
| 4,506,884 | 3/1985 | Hankin . | |
| 4,799,475 | 1/1989 | Iams . | |
| 5,004,229 | 4/1991 | Lind . | |
| 5,108,090 | 4/1992 | Reed . | |
| 5,259,824 | 11/1993 | Cheltenham . | |
| 5,295,935 | 3/1994 | Wang | 482/907 |
| 5,330,408 | 7/1994 | Westmoreland, Jr. | 482/141 |
| 5,499,961 | 3/1996 | Mattox | 482/132 |

*Primary Examiner*—Jerome Donnelly
*Attorney, Agent, or Firm*—Dvorak and Traub

[57] ABSTRACT

An exercise apparatus for performing forward and/or lateral extension type exercises has one or more grip means in combination with a guide means. The grip means comprises a handle means, such as a shaft, around which the hand can be wrapped during use, and upon which the weight of the user can be applied through the hands. The grip means also comprise a means for permitting sliding or rolling movement of the grip means within conforming guide means. These movement means may be wheels located rotatably on the handle shaft, or simply a low-friction undersurface for sliding movement. The guide means also has adjustable stop means for fixing the distance along which the grip means are permitted to move within the guide means.

10 Claims, 10 Drawing Sheets

EXERCISE APPARATUS

BACKGROUND OF THE INVENTION

The present invention relates to an exercise apparatus. In particular, the invention relates to an exercise apparatus having one or more hand grip means/body supports in combination with a guide means, designed to promote and gradually improve an exerciser's ability to safely perform forward and lateral extensions and other push-up type exercises.

Various types of exercise equipment and exercises are known in the prior art. U.S. Pat. No. 1,982,843 to Traver teaches a gliding type ski and rowing exercises having two parallel guide means and independently sliding block means therein. Fixed abutment points are provided at either end of the guide means to prevent further movement of the block means once they travel the length of the guide means. The two block means may be joined together by a seat for rowing type exercises.

U.S. Pat. No. 4,506,884 to Hankin teaches an apparatus for exercising leg muscles. A set of parallel guide means has two independently slidable plates, the plates having wheels which ride within the guide means. Stop means are included on the guide means, comprising holes set along the length thereof, and protruding pegs. Situated on the slidable plates are further plates which are rotatably fixed on the slidable plates. The knees are simply frictionally rested on top of the plates.

The devices of Traver and Hankin are both designed specifically for the exercise of leg muscles. Because of the completely different orientation and much greater degree of difficulty required for upper body exercises of the lateral or forward extension type, these devices do not allow a user to properly grip and support the body, and do not permit a safe and viable means for performing the desired exercises. Several prior art devices are known which are intended to be used for lateral and forward extension. However, they are in general deficient in providing the needed guidance and adjustability required for these exercises.

U.S. Pat. No. 2,821,394 to Barbeau discloses a roller-type exerciser comprising a pair of hand grip/body support means in the general shape of bar-bells, in which a pair of wheels is rotatable about a central shaft. The user grips one device in each hand by the shaft and performs rolling type lateral extension push-ups. Tension upon an internal coil spring increases as the devices roll outwardly from the body during the exercise, so as to assist the user in returning to the starting position in which the hands are close to the body.

U.S. Pat. No. 3,403,906 to Burzenski teaches an exerciser comprising a shaft and a wheel rotatable on the shaft located inwardly thereof. A user can grip the shaft with both hands via handle means on either end, and perform a number of rolling type exercises.

U.S. Pat. No. 3,134,590 to Young teaches a rollable exercising device with a built-in braking means. The Young device does attempt to overcome one of the problems associated with the prior art, namely that it does make possible a gradual change in difficulty in performing a roller type exercise. The Young device has an internal braking mechanism which engages after the device has been rolled a certain distance. That certain distance must be set before each exercise set by placing the device at the farthest distance desired and rolling the device towards the user. When the device is then pushed out in a rolling manner during the exercise, the brake will engage at the pre-set distance. However, since the braking distance is dependent on the continuous rolling of the wheels, any break in that continuity will alter the effectiveness of the brake. For example, any slippage occurring between the wheel and the exercise surface during the exercise will act to lengthen the braking distance, possibly to the detriment of the user. In addition, as the braking mechanism is internal, it is quite possible that the brake can not fully counter the strong inertial outward movement of the arms of the user once braking point is reached, resulting in the entire device continuing its outer path even under internal braking conditions.

It is therefore an object of the invention to provide an apparatus for safely performing lateral or forward extension type exercises that can be performed in graduated degrees of difficulty along a controlled path.

SUMMARY OF THE INVENTION

Accordingly, the present invention comprises one or more hand grip means/body supports in combination with a guide means. The grip means/body supports (hereinafter referred to as simply "grip means") may comprise a handle means around which the hand can be wrapped during use, and upon which the weight of the user can be applied. In addition, the handle means can be any means by which the hand, arm or other body part can be secured to the grip means. The grip means also comprises a means for permitting sliding or rolling movement of the grip means within conforming guide means. These movement means may be wheels located rotatably on the handle shaft, a low-friction under-surface for sliding movement, means comprising rollers, ball-bearings or the like, or any similar means for allowing movement. The guide means rests on the floor or other surface, or may be located above the surface by way of legs or adjustable lifting means. In addition, the guide means can be suspended from above, in order to modify the difficulty of the exercises. The guide means can be secured to a floor surface in a fixed manner, or by way of a slip-resistant underside. In conjunction with the guide means, the apparatus may also have stop means for fixing the distance along which the grip means are permitted to move within the guide means.

FIG. **10*a*** is a perspective view of a specialized block means.

Figure 10A:
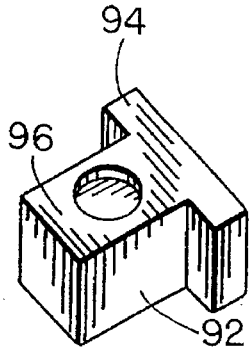

FIG. **10*b* is a top plan view of a specialized block means of FIG. 10*a*** shown in conjunction with a conforming receiving means.

Figure 10B:
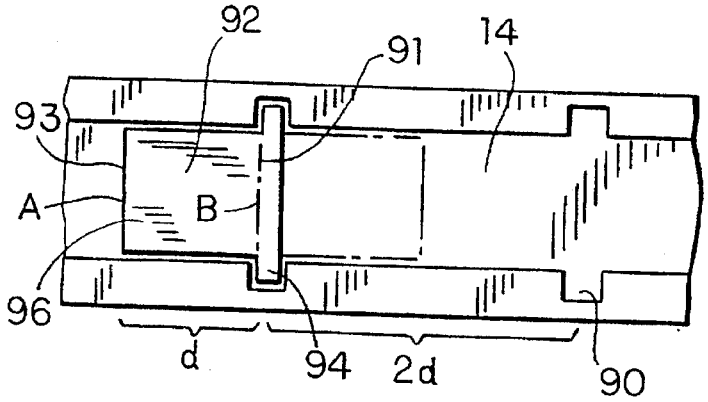
Figure 10C:
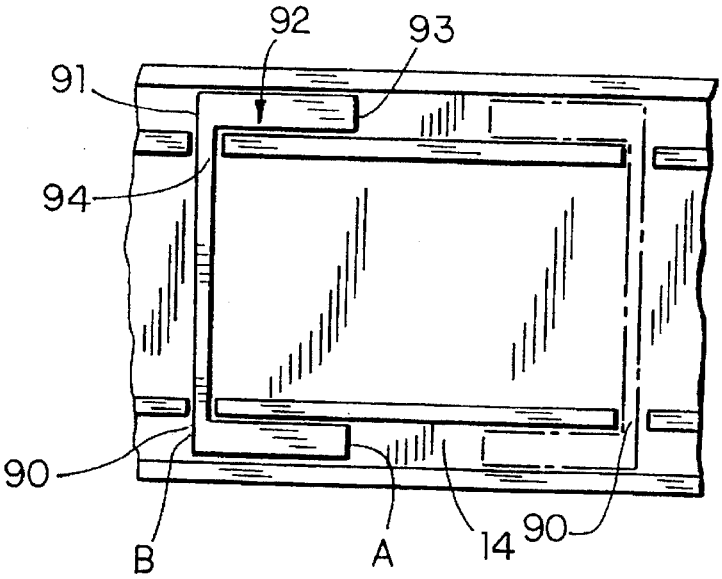

FIG. 10*c* is a top plan view of a different embodiment of a specialized block means shown in conjunction with a conforming receiving means.

Figure 11:
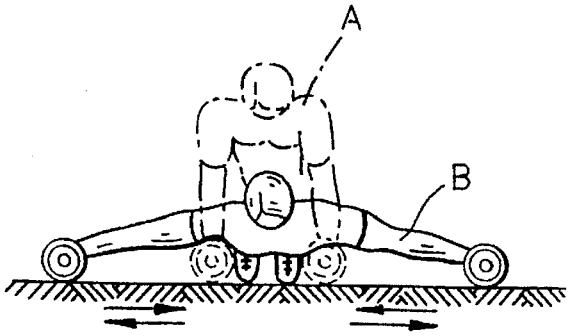

FIG. 11 is a lateral schematic view showing how one possible exercise is performed.

Figure 12:
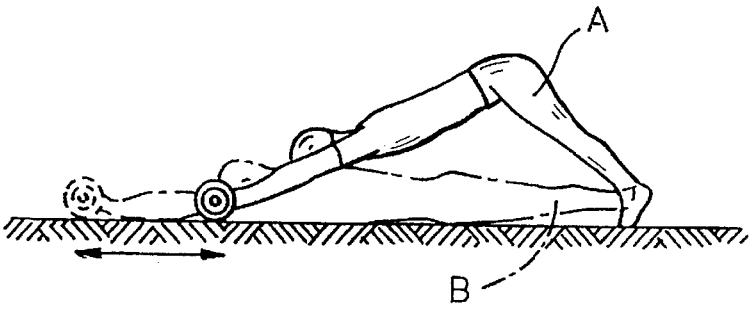

FIG. 12 is a lateral schematic view showing how a second possible exercise is performed.

Figure 13:
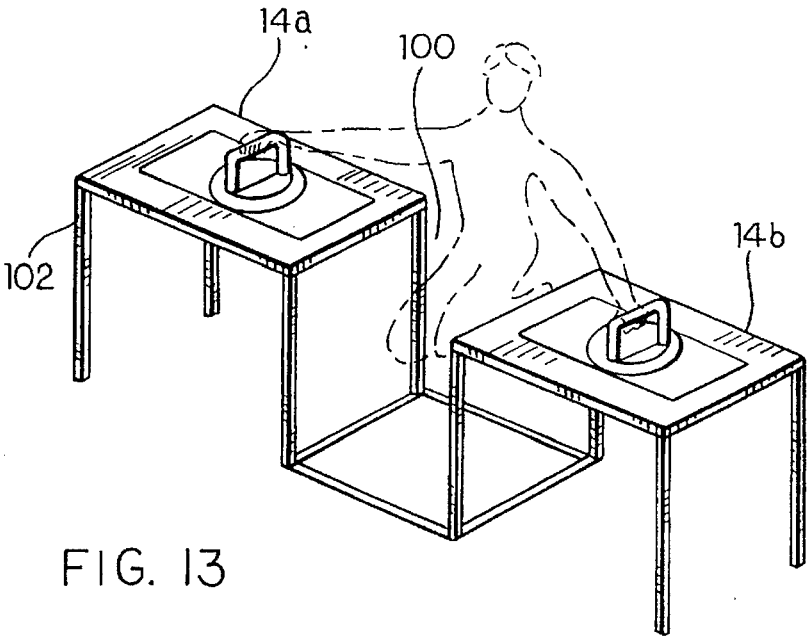

FIG. 13 is a perspective view showing an iron-cross type embodiment of an exercise of the invention.

Figure 14:
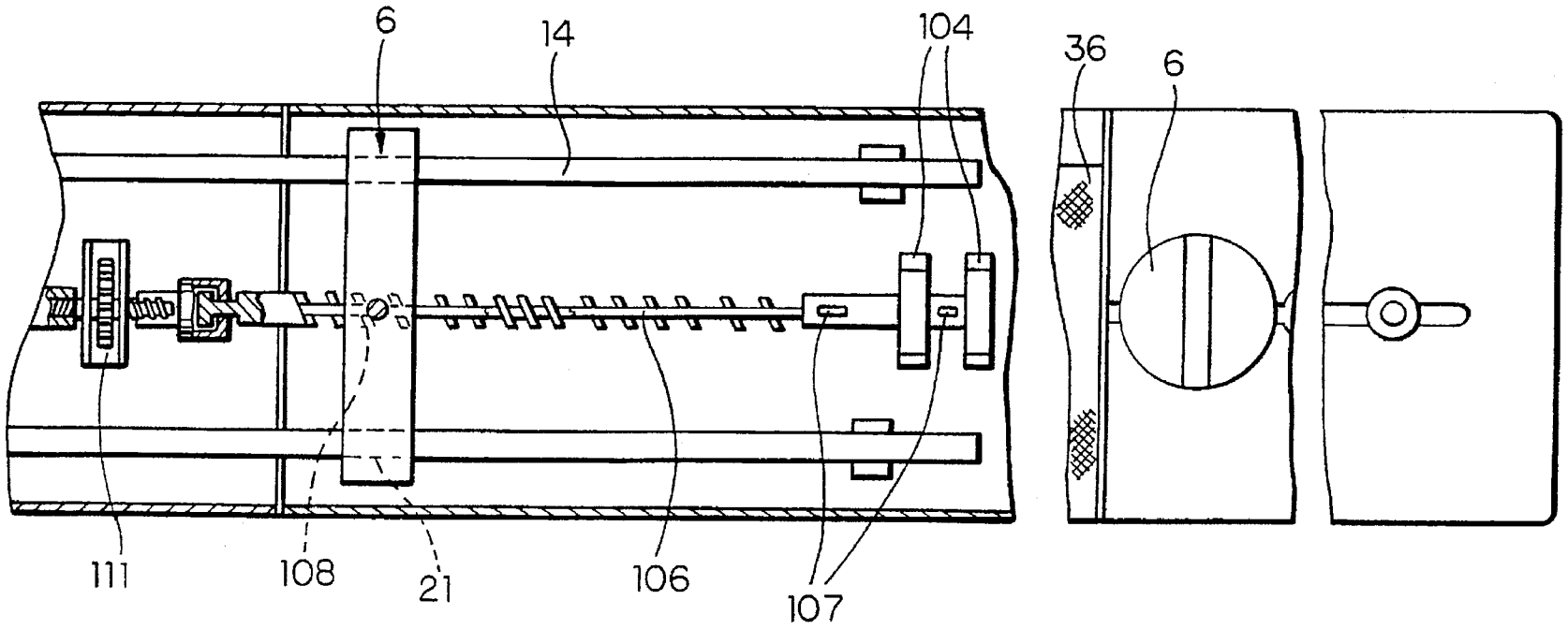

FIG. 14 is a top schematic view in partial cut-away of an embodiment of the invention having a means for assisting the user during the exercise.

Figure 15A:
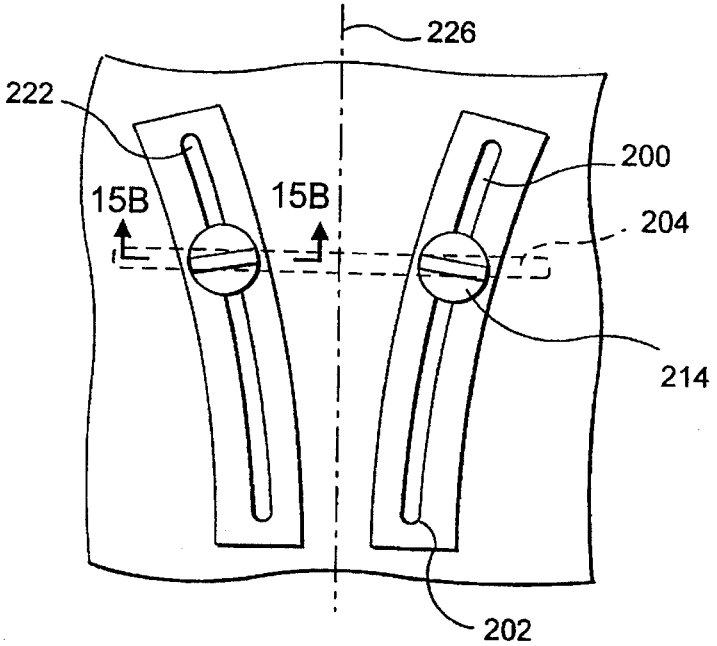

FIG. 15*a* is a top plan view of an embodiment of a forward extension type apparatus.

Figure 15B:
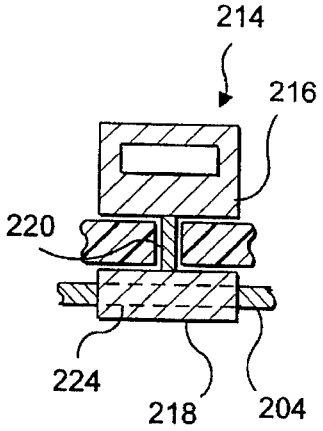

FIG. 15*b* is a cross-sectional view taken along line XV—XV of FIG. 15*a*.

Figure 16:
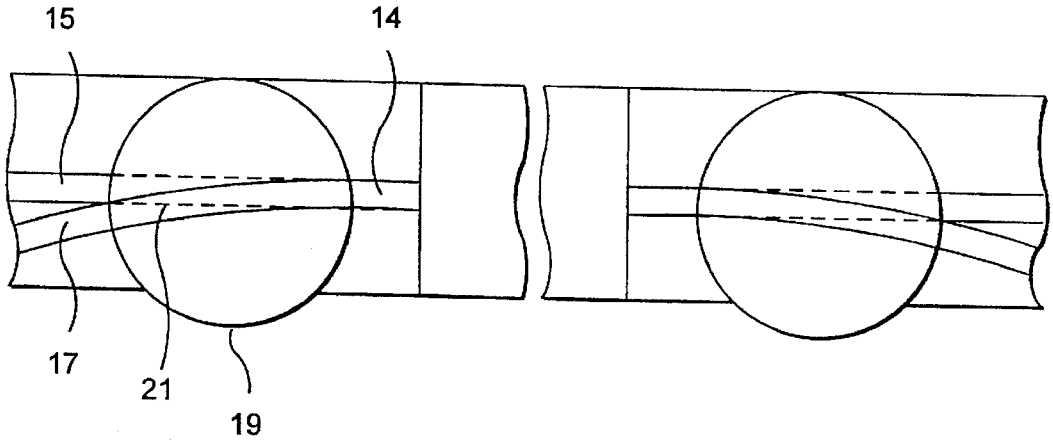

FIG. 16 is a view of a switching means.

DETAILED DESCRIPTION OF THE INVENTION

Figure 1:
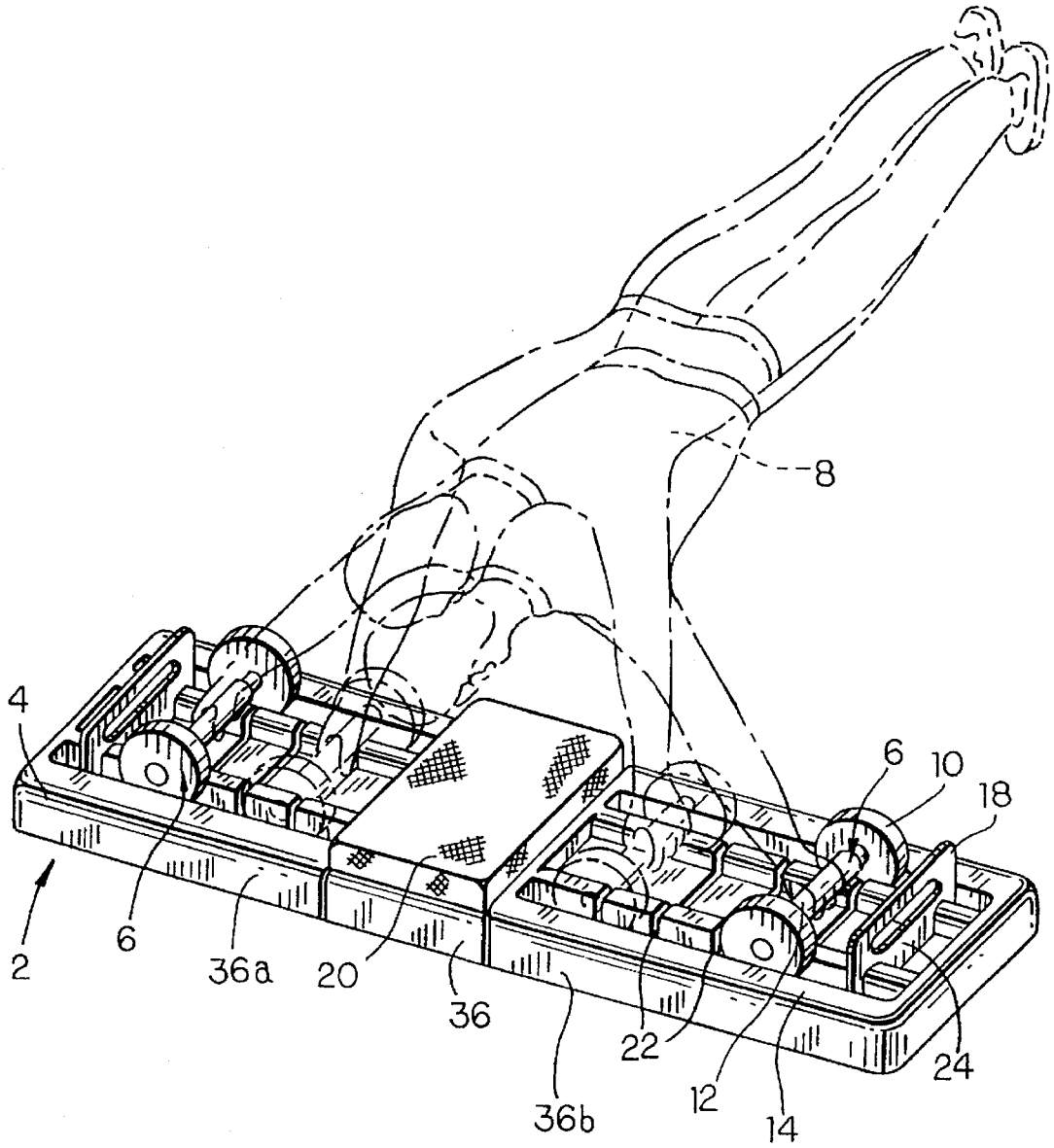
FIG. 1 is a perspective view of a first embodiment of an exerciser of the invention, showing the exerciser in use.
Figure 2:
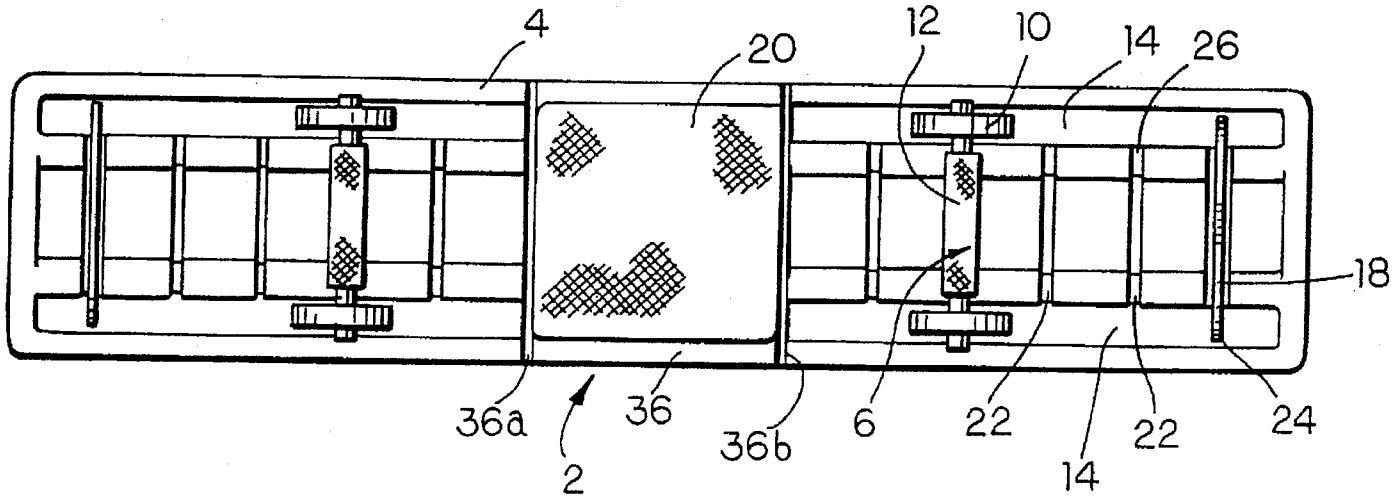
FIG. 2 is a top plan view of the exerciser of FIG. 1.

Referring now to the drawings and in particular to the embodiment in FIGS. 1 and 2, the present invention comprises an exercise apparatus 2 including a guide means 14 and one or two grip means 6. The guide means may optionally comprise a separate support body 4. However, the guide means may also itself act as the support body. The support body 4 (or simply the guide means) may be secured against movement, for example by way of bolts or the like or by slip-resistant pads (not shown). The guide means body 14 is generally elongate, and should have sufficient length to accommodate the full outstretched reach of an average user 8. In the embodiment shown in FIG. 1, grip means 6 are provided in the form of a bar-bell type device having two wheels 10 rotatably secured to either end of a central shaft 12. The guide means 14, is in the form of spaced apart, parallel tracks or rails 16, which generally conform to the thickness of the wheels, such that the wheels may rotate freely within the guide means along the length thereof, while lateral movement of the wheels is restricted. Although, in the embodiment shown, it is possible to vertically lift the grip means from the guide means, it is contemplated that means may be provided which act to retain the grip means in place with respect to movement thereof in a direction perpendicular to the slide surface, for example by acting upon the wheels from above or upon the ends of the shaft. Furthermore, while the guide means shown are strictly linear, it may be advantageous in terms of exercising to provide a curvilinear track, in the form of an arc or parabola, or other non-linear arrangement. In addition, two guide tracks or other means can be straight, while being at an angle to one another.

Further still, a single guide means can comprise two alternate tracks, for example, a linear track and a curvilinear track, and a switching means which directs the grip means along the desired track. Such a switching means, can be for example of the type used for railroad track switching, and is shown schematically in FIG. 16 with the apparatus set for a curvilinear path. The guide means 14 defines, in this case, two different tracks 15,17 along which a grip means (not shown) can travel. A switching means 19 comprises a portion of track 21 conforming to the tracks 15,17, and the switching means 19 is is pivotable, and preferably lockable, in positions aligning with one or the other of the tracks 15,17.

Figure 3A:
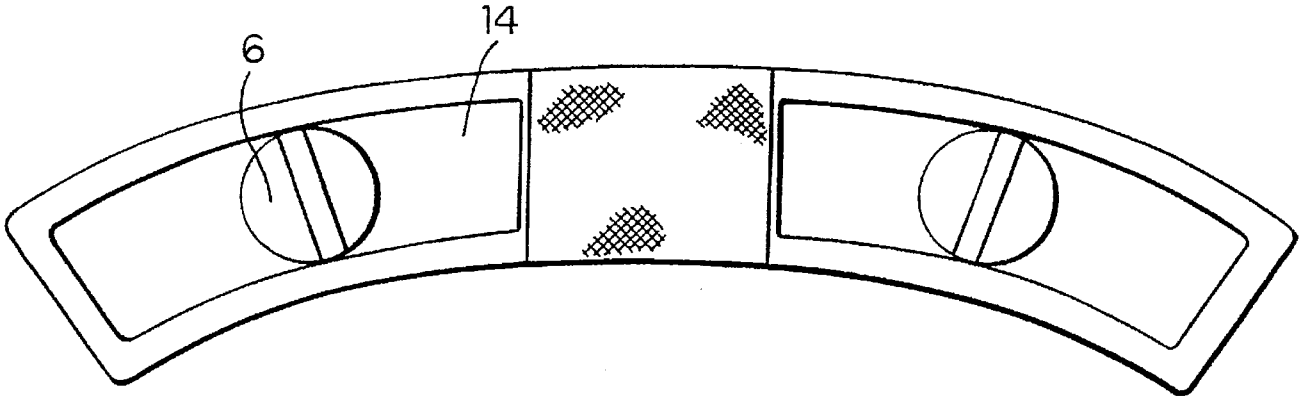
FIG. 3A is a top view of a second embodiment having a curvilinear track.
Figure 3:
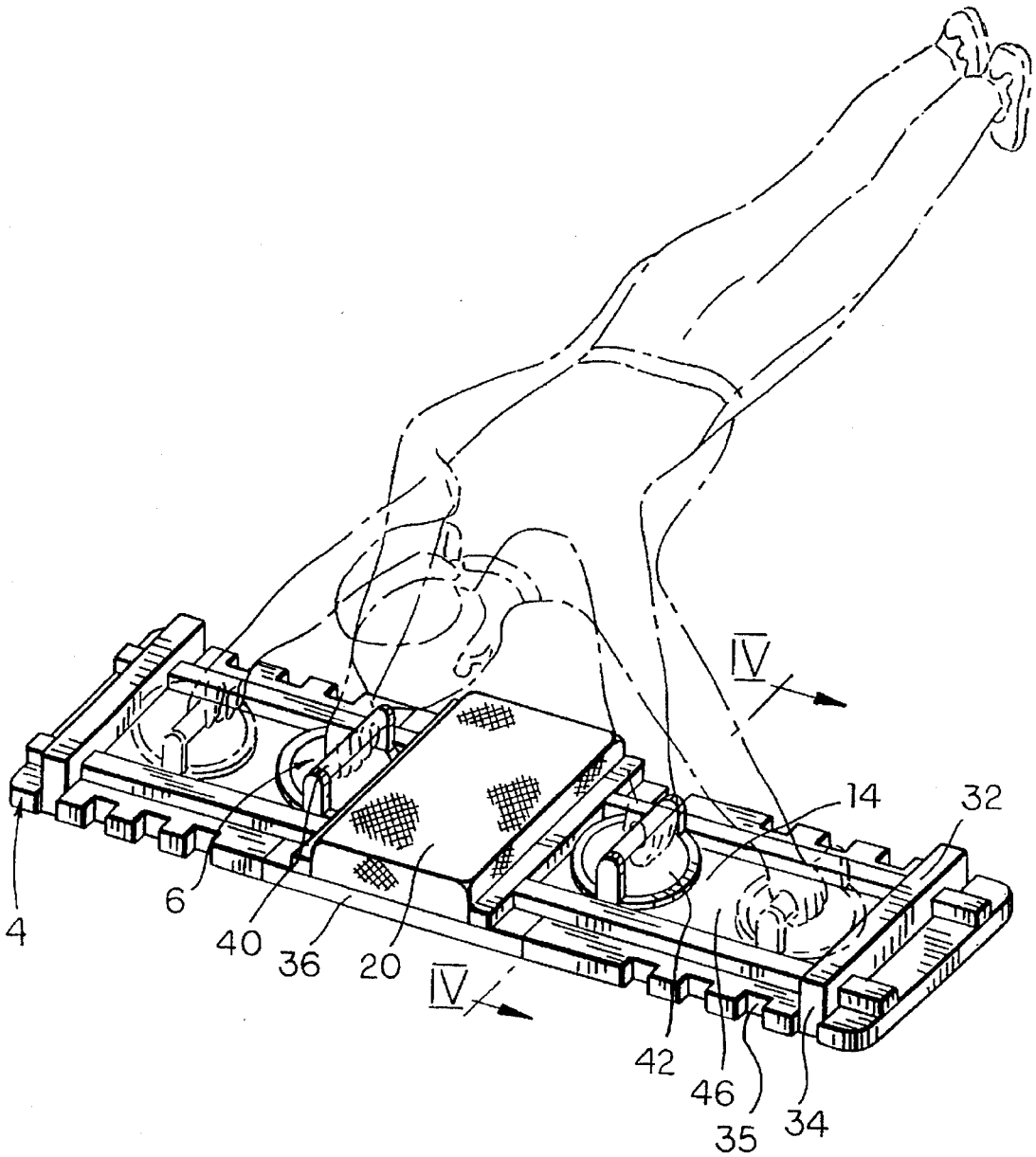
FIG. 3 is a perspective view of a second embodiment of an exerciser, showing the exerciser in use.
Figure 5:
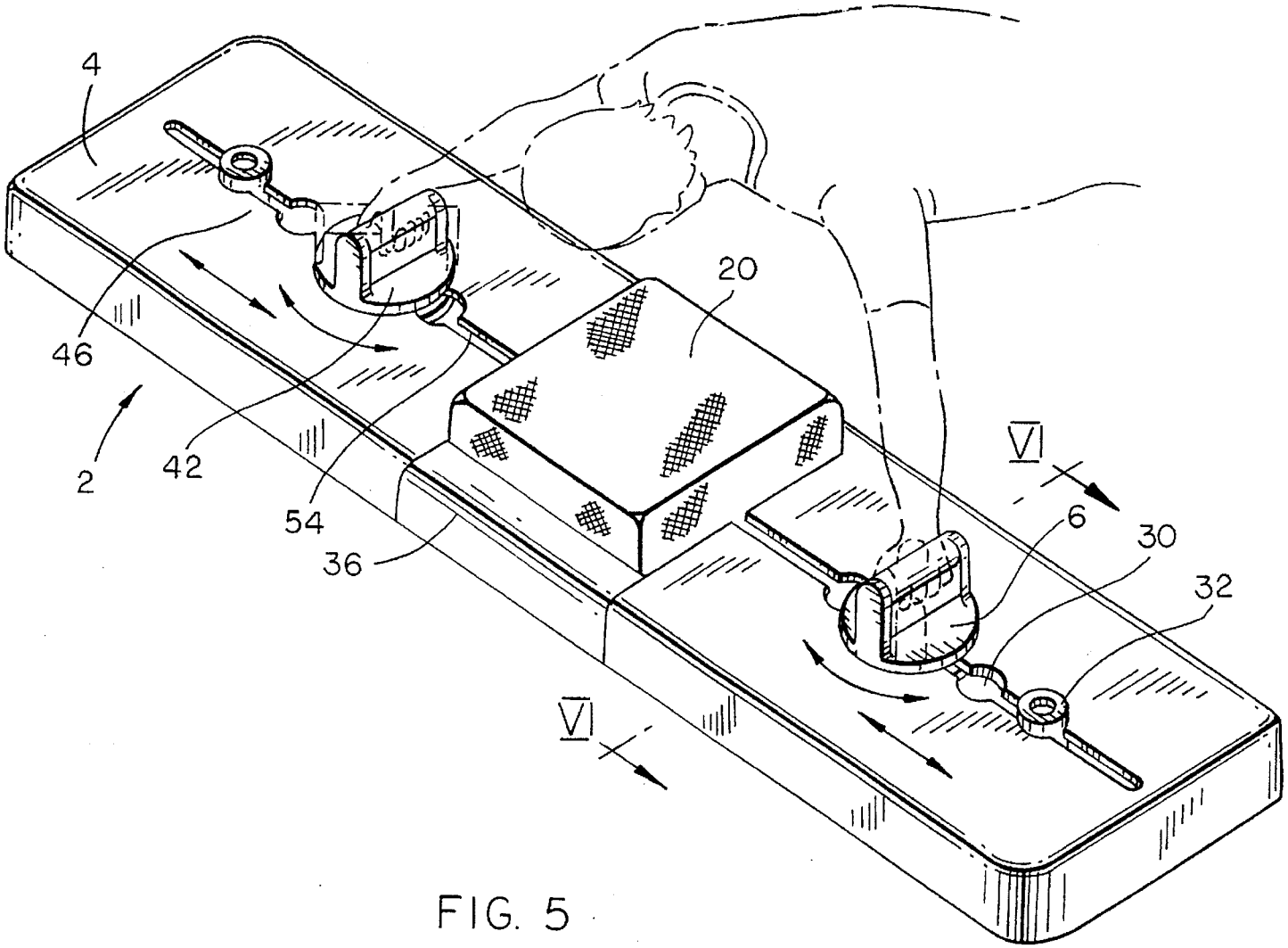
FIG. 5 is a perspective view of a third embodiment of an exerciser.

Stop means 18 may be provided along the length of the guide means 14, which stop means 18 act as an abutment against further outward movement of the grip means 6. In addition, a second set of stop means can be provided inwardly of the first set, to act as an abutment against further inward movement of the grip means. Preferably, the stop means are adjustable, so as to permit the user to locate the exercise path along any portion of the guide means, and for any length. In the embodiment shown in FIG. 1, the outer edges of the central pad 20 can act as a fixed inward stop means. The adjustable stop means 18 may comprise a series of graduated receiving areas 22 located at set distances along the length of the guide means 14, in combination with movable or removable block means 24 which co-acts with the receiving areas 22 to rigidly block the further movement of the grip means 6 along the guide means 14. For example, as shown in FIGS. 1 and 2, the receiving areas 22 may be lateral slots 26 perpendicular to the guide means 14 which receive block means 24 in the form of a conforming slat 28. Another embodiment of the stop means may comprise a series of cylindrical vertical holes 30 and conforming pegs 32, as shown in FIG. 5. A still further embodiment may comprise a block means consisting of bar 32 and two conforming pegs 34 extending from either end for fitting into parallel receiving holes 35, as shown in FIG. 3. It should be clear, however, that any such combination of receiving area 22 and conforming block means 24 can be utilized to achieve the objects of the invention. This could include, as well, a stop means which can be adjusted to be located at any point along the length of the guide means, for example, by providing a block means which can slide along the guide means and be tightened directly thereabout by way of a set screw or the like. The stop means may also be any means which prevents further movement of the grip means, including means internal to the grip means or guide means. In a preferred embodiment shown in FIG. 1, for use with an exercise of the lateral extension type, the support body has a central portion 36 from which the guide means 16 extend at either side 36*a*,36*b* thereof. The central portion 36 may advantageously have padding 20 upon which the user may rest in case of difficulty while performing the exercise.

Figure 4:
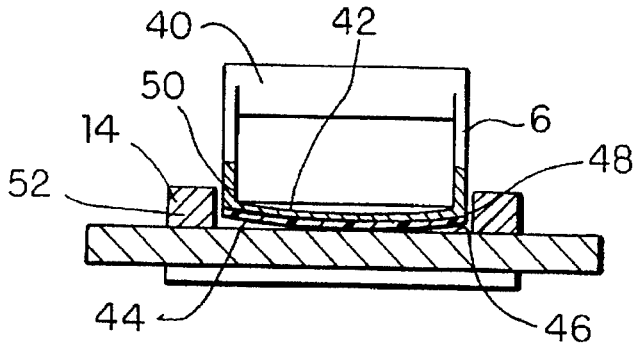
FIG. 4 is a cross-sectional view of the exerciser of FIG. 3, taken along line IV—IV.

In a different embodiment of the invention, shown in FIGS. 3 and 4, the grip means 6 comprises a handle portion 40 in the form of a support bar secured to the upper side of slidable body 42. In the invention in general, the handle portion may alternatively be securing means, such as a sleeve or an adjustable strap or buckle or the like. However, in general, a handle portion of the type comprising a horizontal shaft supported on the grip means, is preferred, as it permits the user to wrap the hand securely around the shaft and to apply the full weight to the grip means. The slidable body 42 has a low-friction, bottom surface 44 for sliding along a slide surface 46, which is preferably provided on the guide means 14. The guide means 14 may be a wide track for retaining the slidable body 42 by way of the perimeter 48 thereof as it slides along the length of the guide means 14. In an embodiment in which the guide means is a wide track, the width or diameter of the slidable body should generally conform to the width of the guide means, i.e. to the distance between the rails thereof. The perimeter of the slidable body may be of any suitable shape. For example, a body may have two parallel sides (either straight or curved, depending on the shape of the guide means), or may be elliptical, so as to allow for a limited degree of rotation within the guide means. In the embodiment shown, the slidable body 42 has the perimeter of a circle. This has a dual advantage, in that it reduces the frictional contact area between the perimeter 48 of the slidable body 42 and the inside 50 of the rails 52, and also permits rotational movement of the grip means 6 within the guide means 14. Such rotational movement will allow the user to rotate the hands as the exercise proceeds, thus involving a wider range of muscles. Such rotation is particularly advantageous in an embodiment having a guide means defining a curvilinear path, as the user's hands can remain along a parallel axis, as the arms move in curvilinear fashion (see FIG. 3A). As above, this embodiment of the grip means can either be freely removable from the support body in an upward direction, or may be slidingly retained thereon, for example by way of a tongue and groove arrangement between the perimeter of the slidable body and the guide means. Stop means may be provided as discussed above, for example by providing a series of spaced apart parallel slots and removable conforming slats. As shown in FIG. 4, in order to decrease the frictional contact surface, it may be advantageous to provide the bottom surface 44 of the slidable body 42 in the form of a convex parabolic dish, or other shape having a reduced contact area. In such a case, the slidable body should be supported at opposing lateral edges thereof. It should be clear that any low friction means may be provided to allow the grip means to slide along the slide surface of the guide means, such as ball bearings, rollers, low friction material, internal or external lubrication, etc. In a simplified version, the guide means may have a space where the slide surface would be, allowing a smooth floor surface to act as the slide surface.

A free-standing device is also possible when using a grip means of the sliding type, as shown in FIG. 3. Such a device would comprise a body having a low-friction bottom sliding surface for sliding on a surface, and a specially adapted handle means configured to allow the hand of a user to be wrapped therearound. Preferably, the handle means is a generally cylindrical shaft oriented parallel to the bottom surface. Even more preferably, the bottom surface can in the shape of a convex parabolic dish so as to reduce friction with the surface.

Figure 6:
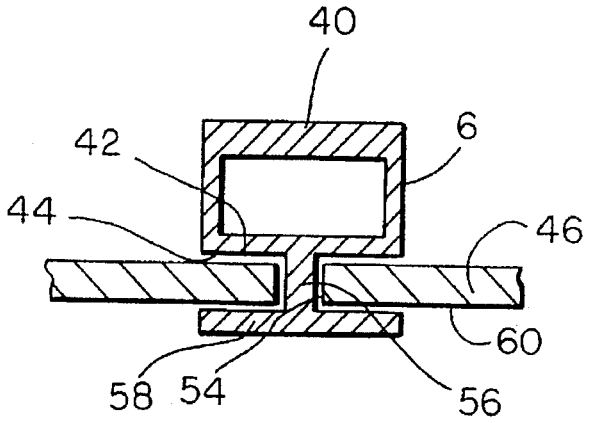
FIG. 6 is a cross-sectional view of the exerciser of FIG. 5, taken along line VI—VI.

Another arrangement is shown in FIGS. 5 and 6, in which the guide means is single narrow track 54. The slidable body 42, shown as circular although any shape can be used, has projecting downward from the center of the bottom surface 44 a shaft 56, the diameter of which conforms to width of the track 54. The shaft 56 may be circular in cross-section so as to permit rotation of the hand grip 6 within the guide means 54, or may elliptical to permit limited rotation. Alternatively, the cross-section of the shaft may have at least one straight-edge to prevent such rotation. In order to prevent vertical lifting of the grip means 6, a second slidable body 58 may be attached, either permanently or removably, to the other end of the shaft 56, and located on the underside 60 of the slide surface 46 of the guide means 14. Stop means may be of any suitable formation, such as the pegs 32 and holes 30 shown in the figures.

Figure 7:
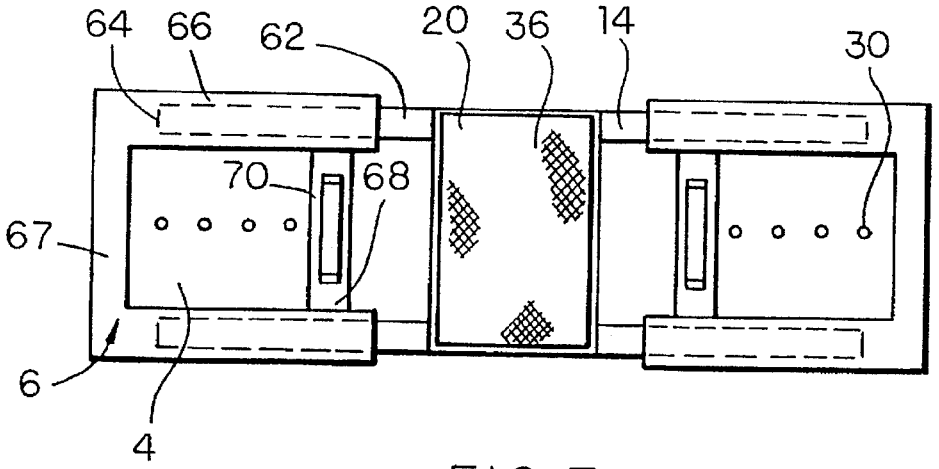
FIG. 7 is a top plan view of a fourth embodiment of an exerciser.

A still further embodiment is shown in FIG. 7. The guide means comprises two sets of parallel shafts 62 extending away from the center 20 of the guide means 14, and free at the opposite ends 64 thereof. The grip means 6 comprises a conforming set of parallel hollow tubes 66 which surround the shafts 62 and are slidable thereon. The hollow tubes 66 are connected by a support bar 68, which acts as the handle to be gripped by the user. An additional support may be added for additional stability, connecting the pair of hollow tubes. An extension of the handle 70, or a separate bar, is located outward of the handle 68, to contact the block means. This embodiment can also work in the reverse, i.e. wherein the guide means comprises hollow tubes, and the hand grips comprise shafts which slide within the tubes. Stop means may be provided along the shafts, tubes, or along the guide means, in which case they coact with the handle portion.

Figure 8:
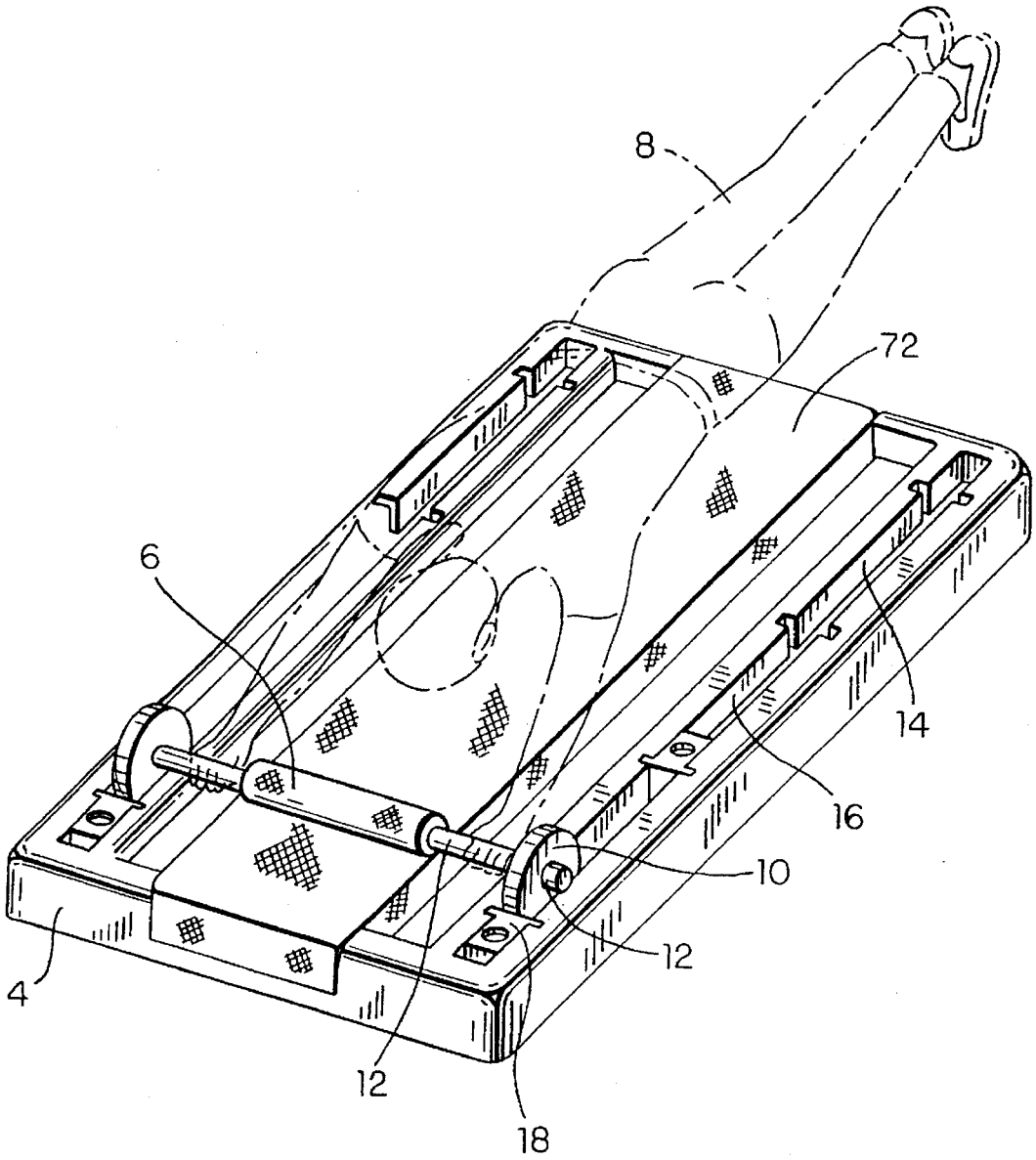
FIG. 8 is a plan view of fifth embodiment of an exerciser.

An embodiment of the invention is shown in FIG. 8 allowing for a modified form of exercise known as a forward extension, in which the guide means 14 is continuous, uninterrupted by a discrete central portion. A single grip means 6 rides within the guide means 14, and central padding 72 may be advantageously provided along the central longitudinal portion of the guide means 14 to protect the user 8. Stop means 18 of any suitable type as discussed above may be used, to provide preferably adjustable abutment points for both the outward and inward exercise motions. A preferred embodiment of a forward extension type of exerciser provides for the guide means 14 as a set of parallel tracks 16, and the grip means 6 being a bar-bell type device. The shaft 12 of the hand grip may extend beyond the wheels 10 on both ends thereof, to allow the user to grip the shaft 12 either inwardly or outwardly of the wheels 10.

It should be clear to one skilled in the art the forward extension type of exerciser can use any of the grip means, guide means and stop means embodiments contemplated for the lateral extension type of exerciser described. In addition, the forward extension type of exerciser may utilize two separate hand grips riding along a set of guide means, which guide means can be parallel, at angles to one another, or curvilinear, so that the user can perform the exercise with each hand independently. Furthermore, it is possible to perform exercises of both types described above in a device which is adaptable. Such an adaptable device may comprise, for example a continuous guide means running essentially the length of the apparatus, by which a forward extension exercise can be performed. Stop means, including a central portion acting as a stop means, may then be removably provided somewhere along the central portion of the guide means to allow lateral extension exercises to be performed.

A preferred embodiment in which the paths of the guide means angle or curve away from each other will now be described. With reference to FIGS. 15*a* and 15*b*, an embodiment of the forward extension type apparatus may have a guide means comprising a pair of angled or curvilinear tracks 200 which move away from each other as the distance from a starting point 202 increases. This enables the user's arms to gradually spread apart as the arms are moved toward and then beyond the head during full extension. The pair of grip means 214 may move independently, or as in the embodiment shown, may be linked to maintain parallel positions. This may be accomplished by providing a linking means 204, for example an axle shaft between the two grip means. The grip means may comprise two parts, an upper portion 216 for gripping by the user, and a lower portion 218 connected to the axle shaft 204. The upper portion and lower portion of the grip means should be rotatable with respect to each other, for example by means of a shaft 220, to allow independent movement as the grip means moves along the angled or curved path of the guide means. The axle shaft should be corresponding in length to the distance between the guide means paths at its greatest length, i.e. at the end 222 of the paths. The lower portion 218 of the grip means has a sleeve 224 running therethrough for slidingly receiving the axle shaft. As the grip means are pushed along the path toward the end thereof, the grip means will move farther apart from each other. The grip means, via the lower portion thereof, will slide outward on the axle shaft, which will act to maintain the grip means in parallel. Although sleeve of the lower portion of the grip means will remain oriented perpendicular to the longitudinal axis 226 of the apparatus, the lower portion will in fact rotate with respect to the path itself. Meanwhile, the upper portion of the grip means, rotating independently of the lower portion, may rotate slightly with respect to the longitudinal axis of the apparatus, as the exercise proceeds so as to provide comfort to the user. It may be advantageous to provide the lower portion and axle shaft below a covering portion 228 of the apparatus so that only upper portion is exposed. This will allow the user to proceed with the exercise without having the axle shaft exposed above. To provide further stability with respect to maintaining parallel movement of the grip means, the axle shaft may optionally have stabilizing means, for example a further guide means cooperating with the axle shaft, running in the longitudinal direction.

Alternatively, the grip means may be one piece riding along and rotatable with respect to the path, with a sleeve for cooperating with the axle shaft. In such a case, the one piece grip means would not be rotatable with respect to the longitudinal axis. It is clear that the above described arrangement may also be practiced in conjunction with a lateral extension apparatus wherein the two guide means sections are angled or curvilinear.

Figure 9:
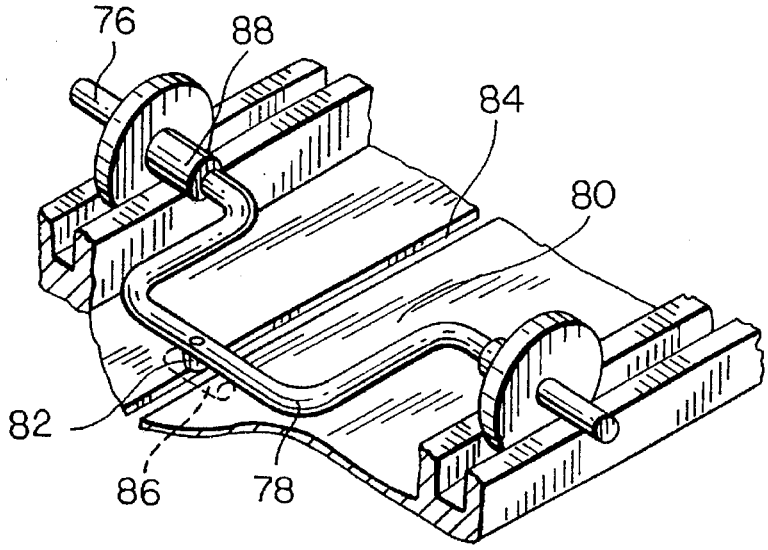
FIG. 9 is a partial perspective view of a sixth embodiment of an exerciser.

In order to further protect the user when descending towards the support body 4 in the forward extension type of exerciser, a specialized shaft 76 may be provided. FIG. 9 shows a shaft having a U-shaped central portion 78, positioned such that there is an open area 80 directly below the head of the user. There may be a tendency for the U-shaped portion 78 to rotate upward towards the user, or to drag along the surface of the support body during the exercise. Therefore, a means may be provided to prevent such upward rotation. This means can be, for example, a downward projection 82 from the U-shaped portion 78 which can slidingly engage a continuous retaining means 84 in the form of a longitudinal slot located along the length of the guide means by way of wing nut or flange 86 on the projection which can grip the underside of the slide surface. To prevent dragging of the central portion of the shaft, a central wheel or other movement means can be provided thereon in conjunction with a guide track running along the central portion of the support body, or protective pad. It may be advantageous to provide cylindrical sleeves 88 around the portion of the shaft to be gripped by the user, which sleeves 88 are permitted to freely rotate about the shaft 76.

In addition to the arrangements for the stop means discussed above, a particularly advantageous arrangement is shown in FIGS. 10*a*, 10*b*, and 10*c*. In this type of arrangement, a stop means is provided which can provide for an abutment point at two different locations A,B along the length of the guide means 14. A block means 92 comprises an engaging portion 94 located near a first end 91 of the block means, which engaging portion engages a receiving area 90. The first end 91 of the block defines a first abutment location B. The second end 93 of the block means is longitudinally offset from the first end 91. The block means 92 and the receiving areas 90 are formed such that the block means can be held in the receiving areas in either of two directions by way of the engaging portion 94, i.e. so that either the first or second ends 91,93 of the block means faces the center portion of the guide means. As the second end 93 of the block means is offset, it defines a second abutment point B located closer towards the center portion as compared to the first abutment point.

A particular embodiment is shown in FIGS. 10*a* and 10*b*. Pairs of slots 90 are provided along the length of the guide means 14 to act as receiving areas. Block means 92 are formed as a combination of an engaging portion in the form of a slat 94 and a preferably rectangular peg 96, wherein the slat 94 is provided as wings extending laterally from either side of the peg 96 at or near a first end 91 thereof. A block means of this type can be fit into the slot 90 in either of two directions, such that the abutment point is located either close to or at the point of the slot 90 (position B), or at some distance away from the slot 90 as determined by the length of the peg 96 (position A). Another embodiment of this type of stop means is shown in FIG. 10*c*, for use with a guide means comprising at least two parallel tracks.

By using this type of stop means, fewer receiving areas need to be provided. This can be important from an engineering standpoint to save costs and efforts in manufacturing, and to provide greater stability to the guide means. For example, with reference to FIG. 10*b*, if it is desired that abutment points be located apart from each other at a distance d, blocks or pegs 96 of this type can be provided with a length d, while it will only be necessary to provide slots 90 spaced apart at length 2d. Thus, the number of slots 90 can be reduced by half.

A further embodiment of the invention is shown in FIG. 13, which is particularly adapted for performing an "iron cross" or similar type lateral extension exercise. The guide means comprises two sections 14*a*,14*b*, and is raised above a floor or other surface by way of legs 102 or other raising means, which may be vertically adjustable. An area 100 is provided between the two sections 14*a*,14*b*, to allow the user to dip his or her body below the level of the guide means, with sufficient clearance to allow the user to keep his or her feet off the ground. The sections 14*a*,14*b* may be separate, or may be adjustably connected.

Additional embodiments may have a means for assisting the user in performing the exercise, particularly at the point at which the arms are outstretched. Such a means may be disengageable to allow the user to proceed unassisted, and can be a spring, coil, rubber or elastic type of band or tubing device, either internal or external of the hand grip, which biases the grip means back towards the starting position. Other means contemplated may include a pneumatic or hydraulic system, a counterweighted pulley system, or a motorized system, working in conjunction with the grip means, which assists the user in reaching the outstretched position, and in returning therefrom.

It is noted that such means will be most needed in the returning portion of the exercise, as this portion is the most difficult. A particular embodiment of this type is illustrated in FIG. 14. The grip means 6 has sleeves 21 at either end thereof which ride along conforming rails 14 of the guide means. The grip means 6 also has a fast threaded nut 108 which rides along a conforming fast threaded rod shaft 106. The rod shaft 106 is connected to a coil spring 104, such that when the grip means 6 is moved away from the center portion of the guide means, the rod shaft rotates and winds the coil spring, thus biasing the grip means back in the direction towards the center portion. As the grip means is moved further away from the center portion, the spring tightens, and increases the biasing force accordingly. This assists the user in returning from the outstretched position. Furthermore, the biasing means can be detachable or adjustable to different forces, by way of a key 107 on the end of the shaft 106, the position of the shaft 106 being adjustable by way of an adjusting means 111, which locates the key 107 to interact with none or either of two (or more) coil springs of different tensions.

The exercise apparatus may also have additional elements which may be helpful to the user. For example, an electronic or mechanical counter means can be provided showing the number of repetitions performed, and display means can be added showing same, or additionally the level of difficulty, distance traveled, time elapsed, calories expended, force applied, etc. In addition, the level of difficulty in terms of resistance, assistance, height off the surface, etc. can be automatically adjusted.

The use of the exerciser of the invention will now be described. The present exerciser is useful for developing various muscles in the body, primarily the back, chest, stomach, arms and shoulders. A lateral extension exerciser is shown schematically in FIG. 11, with reference made to FIGS. 1 and 3. The user locates his or her body such that the chest is approximately over the central portion. The stop means are adjusted for the desired degree of difficulty, such that for a beginner, the stop means are adjusted so as to be close to the central portion. The hand grips are then brought to a starting point close to the central portion, and the user raises him or herself up by supporting the body weight via the hands on the hand grips, and locking the arms (position A). With arms remaining in the locked (or slightly bent) position, the arms are then brought outward from the body until the hand grips reach the abutment points, causing the body to lower towards the guide means (position B). The body is then raised up again by bringing the arms, still locked (or slightly bent), back toward the central position. Other exercises using this type of apparatus may include a user in a sitting position above the central portion, and lifting his or her body as the arms stretched outward and then inward towards the body. Additionally, one may perform a handstand, lowering and raising the body as the arms are moved outward and inward.

For the forward extension exercise apparatus, shown in FIGS. 12 and 8, the standard exercise is performed with the user gripping the shaft of the grip means with both hands (or with one hand on each grip means) with the grip means located towards the user, while positioning the body in the pike position with arms locked (position A). The grip means is then rolled outward away from the body, toward and then beyond the head, still with arms locked until the abutment point is reached (position B), at which point the grip means is pulled back towards the user's body. Difficulty and muscles stressed can be varied by changing the position of the feet, e.g. apart, together, straddled. Exercises can also be performed with the user in the kneeling or sitting position.

In order to vary the exercise, means can be provided for raising the guide means and/or grip means off the ground, either at a rotational angle or parallel to ground surface. This may also change the difficulty level. Such means may include, for example, telescoping legs or a screw type extension mechanism. Furthermore, in embodiments wherein the grip means is slidingly retained on the guide means, the exerciser can be secured to a wall, with the exercise performed in the standing position.

In embodiments of the invention using the bar-bell type grip means, difficulty can be adjusted by substituting wheels of decreasing or increasing diameter, so as to adjust the distance that the chest is permitted to dip below the level of the grip in the outstretched position. Therefore, the apparatus may comprise a plurality of pairs of removable wheels, each pair being of a different diameter than the other pairs. In embodiments using grip means other than the bar-bell type, a similar effect can be achieved by varying the height of the grip means.

It should be understood that variations may be made to the above described invention without departing from the spirit thereof.

What is claimed is:

1. An apparatus for performing lateral extension type exercises, comprising a central body portion and a guide means comprising two sections, one of said sections extending laterally from one side of the central body portion and the other of said sections extending laterally from an opposite side of the central body portion, a pair of grip means, each grip means being movable in conjunction with one section of guide means along a path defined thereby, and stop means for preventing further movement of the grip means along the path, said stop means being adjustable as to location along the length of the guide means, wherein the grip means comprises an axle shaft and a pair of wheels rotatably secured to either end thereof, and the guide means comprises a pair of spaced apart rails, each of said rails comprising a longitudinal base portion and two spaced apart parallel side portions extending upwardly from the base portion so as to laterally retain the width of the wheel in either lateral direction.

2. The apparatus of claim 1, wherein the pair of wheels are removable from the axle shaft, and further comprising a plurality of pairs of wheels of differing diameters which can be placed on the axle shaft to adjust the degree of difficulty of the exercise.

3. The apparatus of claim 1, further comprising a padding element located at the central portion of the support body.

4. The apparatus of claim 1, further comprising means for biasing the grip means toward the central portion.

5. The apparatus of claim 4, wherein the force applied by said biasing means increases as the distance from the central portion increases.

6. The apparatus of claim 1, wherein the path is curvilinear.

7. The apparatus of claim 1, wherein the two sections of guide means adjustably extend from the central portion at angles to one another.

8. The apparatus of claim 1, wherein the guide means comprises a plurality of different paths, and switching means for directing the grip means along a selected one of said different paths.

9. The apparatus of claim 1, further comprising means for adjustably raising the guide means above a surface.

10. The apparatus of claim 1, further comprising means for raising the guide means above a surface, wherein the central body portion comprises an open area, said open area being of sufficient breadth to accommodate the breadth of an average human.

* * * * *